United States Patent [19]

Atkinson

[11] 4,431,158

[45] Feb. 14, 1984

[54] CONTROLLED ROTATION SELF-INVERTING HOT TOP CASING

[75] Inventor: Donald C. Atkinson, Ellwood City, Pa.

[73] Assignee: Koppers Company, Inc., Pittsburgh, Pa.

[21] Appl. No.: 293,319

[22] Filed: Aug. 17, 1981

[51] Int. Cl.[3] ..... B22D 7/00; B22D 7/10

[52] U.S. Cl. ..... 249/197; 249/106; 249/202; 164/342

[58] Field of Search ..... 164/342, 405, 407, 408; 249/106, 174, 197, 198, 199, 200, 201, 202, DIG. 5

[56] References Cited

U.S. PATENT DOCUMENTS 3,794,287 2/1974 Atkinson ..... 249/201 X 3,870,273 3/1975 Perri ..... 249/202

FOREIGN PATENT DOCUMENTS 1370620 4/1963 France ..... 249/201

*Primary Examiner*—Gus T. Hampilos
*Assistant Examiner*—Jerold L. Johnson
*Attorney, Agent, or Firm*—Donald MacKay; Herbert J. Zeh, Jr.

[57] ABSTRACT

A hot top casing for cooperation with an ingot mold body is provided having a depending portion from which a pair of trunnions extend away from the casing and a second pair of trunnions extend toward said casing whereby each of said pairs are displaced vertically with respect to the center of gravity with one pair above and one pair below said center.

2 Claims, 1 Drawing Figure

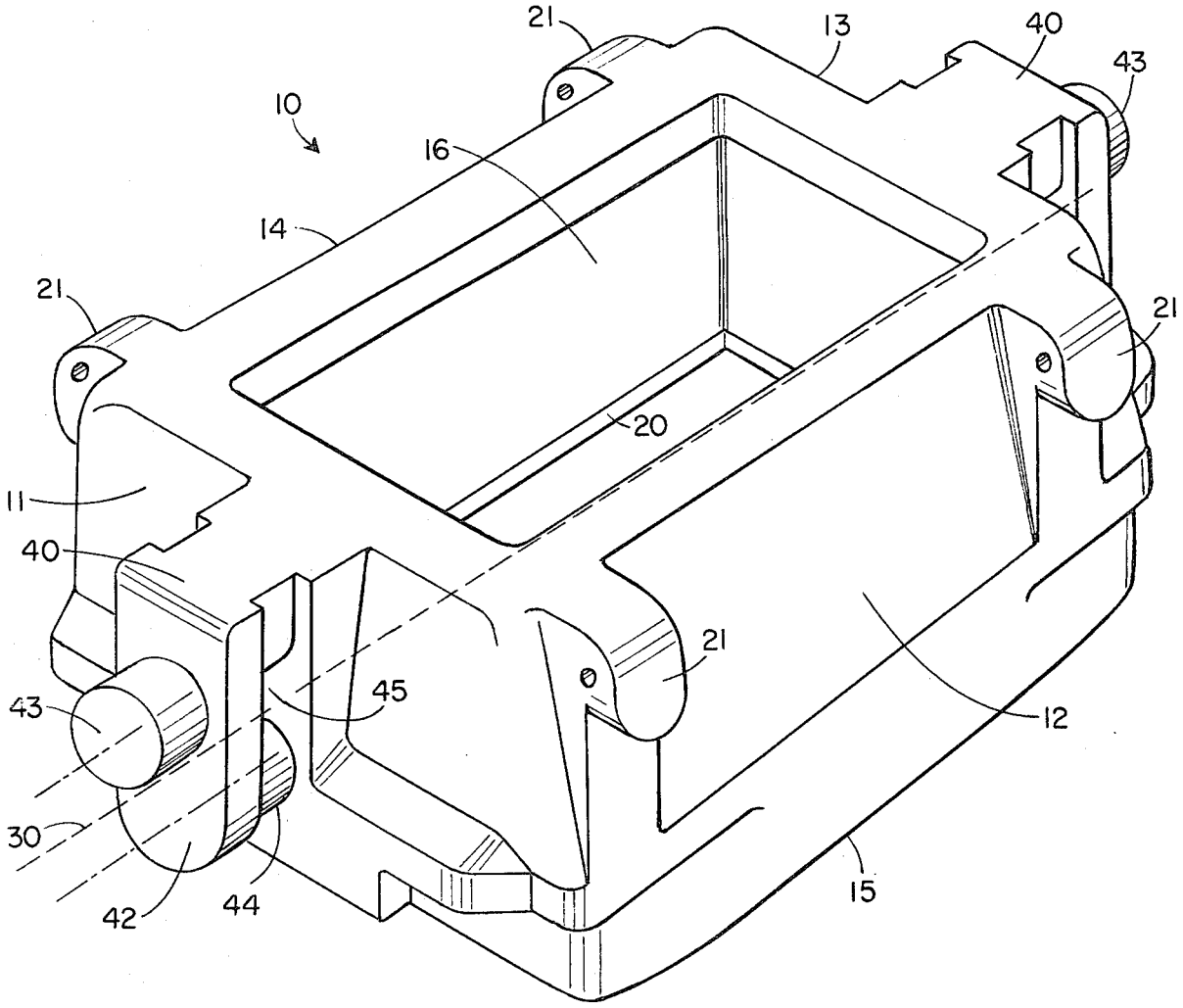
21
13
40
43
10
16
14
21
21
20
11
40
21
45
43
12
30
42
44
15

CONTROLLED ROTATION SELF-INVERTING HOT TOP CASING

BACKGROUND OF THE INVENTION

1. Field of the Invention

This invention relates generally to hot top casing used in conjunction with ingot molds for the pouring of steel ingots and, more specifically to self-inverting hot top casings.

2. Brief Description of the Invention

Self-inverting hot top casings are provided with two pairs of laterally-projecting turning trunnions that are located on diametrically opposite sides of the casing. Both pairs are aligned along the vertical centerline of the hot top casing, but one pair is above and one pair is below the hot top casing's center of gravity. To lift the casing, a J-bale is engaged with a selective pair of trunnions. The J-bale is comprised of a beam having at its center an eye member to be engaged by a crane hook and having at each end a leg shaped like the letter "J". These legs are displaced from each other a suitable distance to engage a selected pair of trunnions.

Conventionally the crane lowers the J-bale to engage the pair of lower trunnions of the hot top casing after the pouring of the steel through the opening of hot top casing into the ingot mold has been completed. The crane then raises the hot top casing stripping it away from the ingot mold. As the J-bale lifts the casing from the mold, an imbalance designed into the casing creates a lateral force to cause the casing to trip, rotate about the trunnions held by the legs of the J-bale, and become inverted. The relative positions of the trunnions have now changed, and former lower trunnions have now become the upper trunnions and the formerly upper trunnions have become the lower trunnions.

The inverted casing is lowered to the floor. The casing is now relined with the thermal insert which may be comprised of panels, refractory or insulating ring, and retaining clamps as required by the particular hot top casing design being used.

When the hot top casing has been made ready for reuse, it is lifted by crane through the use of a "J" bale engaging the pair of trunnions that is now the bottom pair of trunnions. The casing self-inverts to its upright position so that it can be placed on an ingot mold for the subsequent pouring of steel and the foregoing process is repeated. When the hot top casing has been stripped from the ingot and is ready to be relined, it is again lifted by the crane and J-bale engaging the bottom set of trunnions (which were originally the upper set). The hot top casing self-inverts and is placed in the make-up area. Typical of such hot top casing is that described in U.S. Pat. No. 3,879,011.

In order for the J-bale to operate successfully, it has been necessary to displace both sets of trunnions a good distance from the casing's center of gravity. This displacement causes the casing to whip over violently when lifted, creating a great shock load on the J-bale and crane. A fast whip over can destroy ring and insert before the hot top has a chance to clear the make-up area.

SUMMARY OF THE INVENTION

The present invention provides a unique design of self-inverting hot top casing to control the speed with which the casing self-inverts when lifted, thus eliminating the dangerous whip over. The invention accomplishes this control by moving each set of trunnions close to the center of gravity of the casing. The top set of trunnions is superimposed upon the bottom trunnions. A wider J-bale is used to engage the top set of trunnions than is the J-bale which is used to engage the bottom set. This invention permits the hot top casing to self-invert in both directions at a relatively slow rate of speed.

The foregoing and other objects and advantages of the invention will become apparent from a reading of the following description in conjunction with the accompanying drawing.

BRIEF DESCRIPTION OF THE DRAWING

The single sheet of drawing presents an isometric view of an embodiment of the novel hot top casing of this invention.

DESCRIPTION OF THE PREFERRED EMBODIMENT

Turning now to the drawing, an embodiment of the novel hot top casing of this invention has four sides, 11, 12, 13, 14, forming an open structure of rectangular cross-sections. The base 15 is adapted to operate with an ingot mold body so that molten metal may be poured into the open top 16 and flowed through the casing into the ingot mold (not shown).

A conventional replaceable refractory thermal insulating lining (not shown) projects the hot top casing from the effects of the hot molten metal that is passed through the casing. Accordingly, casing 10 has an inner inset 20 to receive the seal for the insulating lining. Also provided are four carrying trunnions 21.

The foregoing has described conventional portions of a hot top casing. Such casings are also generally provided with two separate pairs of lift trunnions extending from opposite surfaces 11 and 13. One pair is positioned above the center of gravity 30 of casing 10 and the other pair is positioned below the center of gravity 30. Usually both pairs are horizontally offset from the center of gravity to give weight imbalance so that casing 10 will rotate when elevated by the lower-most pair of the two pairs of trunnions. Casing 10 is inverted automatically each time it is lifted by the lower-most pair of lift trunnions.

The conventional hot top casings have generally operated satisfactorily, but problems have existed. A major problem has been that to enable the J-bale to operate successfully, it is necessary to place both set of trunnions a considerable distance from the center of gravity of the casing. This distance has the understandable effect of causing the casing to trip, invert or whip-over violently when it is lifted. Such violent action creates a shock load on the J-bale and crane. A fast whip-over can also destroy the seal ring and thermal insert lining before the hot top has had a chance to clear the make-up area.

The present invention provides a unique design to control the speed with which the casing self-inverts when it is lifted. This control eliminates the dangerous whip-over of the conventional system. The present invention accomplishes such control by moving both sets of trunnions close to the center of gravity of the casing. This initially permits the casing to self-invert in both directions at a relatively slow rate of speed; a highly desirable feature that is not possible with the heretofore known hot top casing. The top set of trunnions, through a novel arrangement, is superimposed upon the bottom trunnions. Necessarily, a wider J-bale is required to engage the initial top set of trunnions than is the one which is used to engage the initial bottom set.

Turning now to the drawing, portions 40 of casing 10 each extend laterally beyond the opposite walls 11 and 13 then depend at 42 from the top 16 downwardly toward the base 15. Extending still further laterally from the depending portions 42 are cylindrical upper trunnions 43. Lower cylindrical trunnions 44 join the depending portion 42 with the respective sides 11 and 13. The free spaces 45 between depending portions 42 and trunnions 44 permit the hot top casing 10 to rotate on the J-bales.

The present invention has been described above with respect to a preferred embodiment. It should now be obvious to those skilled in the art that various modifications and alternatives can be introduced without departing from the spirit and scope of the invention as set forth herein and covered by the appended claims.

What is claimed is:

1. A hot top casing comprising a base for cooperation with an ingot mold body; an open top so that the molten metal flows through the casing to the ingot mold; portions extending beyond opposite ends of said casing and each having a further portion depending from the top of said casing downwardly toward the base, said further portions having two opposing sides with one closer to the casing and set between the casing and the other side, each further portion having a trunnion connected to and extending away from each of the two sides, each of said pairs of trunnions being displaced vertically with respect to the center of gravity of said casing whereby one pair of trunnions is displaced above the center of gravity of said casing and the other pair is displaced below the center of gravity.

2. The casing of claim 1 wherein said trunnions are placed sufficiently close to the center of gravity to prevent the casing from turning uncontrollably when inverted.

* * * * *